United States Patent [19]

Regenstein, Jr.

[11] 4,323,189

[45] Apr. 6, 1982

[54] CLOSABLE POUCH

[75] Inventor: Joseph Regenstein, Jr., Chicago, Ill.

[73] Assignee: Arvey Corporation, Chicago, Ill.

[21] Appl. No.: 153,715

[22] Filed: May 27, 1980

[51] Int. Cl.[3] ..... B65D 33/16; B65D 33/18; B65D 33/20

[52] U.S. Cl. ..... 229/62; 150/7; 206/438

[58] Field of Search ..... 206/438, 447; 229/62, 229/55, 485 B; 150/7

[56] References Cited

U.S. PATENT DOCUMENTS

| | | | |
|---|---|---|---|
| 2,793,743 | 5/1957 | Lefebvre | 229/62 |
| 3,446,420 | 5/1969 | Rinecker | 229/62 |
| 3,655,118 | 4/1972 | Rinecker | 229/62 |
| 4,071,186 | 1/1978 | Ruda | 229/62 |

*Primary Examiner*—William T. Dixson, Jr.
*Attorney, Agent, or Firm*—Dressler, Goldsmith, Shore, Sutker & Milnamow, Ltd.

[57] ABSTRACT

Self-sealing closure structures are provided for a pouch having first and second webs secured together partially around an interior portion. Each web has at least one generally straight end edge that defines a portion of the pouch opening and that is in registry with the end edge of the other web. An adhesive sealing strip is disposed on the first web parallel with and near the first web one end edge. Folding of the webs together about two or more fold lines orients the adhesive sealing strip against an adjacent region of the second web to form a closure seal in the pouch. A pharmacy fold may be provided in some of the closures.

8 Claims, 27 Drawing Figures

PRIOR INVENTION

PRIOR INVENTION

PRIOR INVENTION

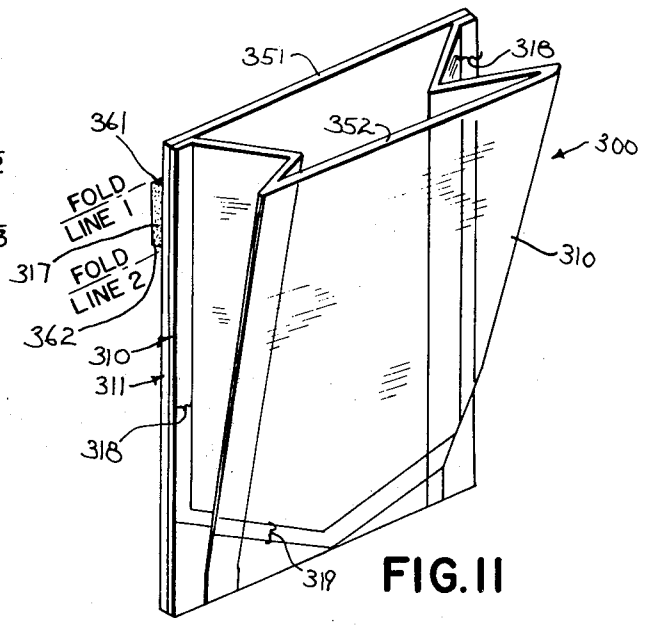
FIG.11
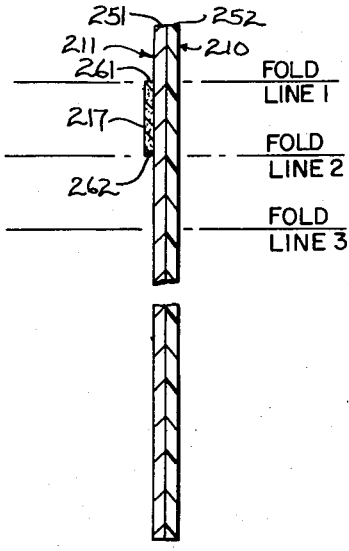
FIG.10
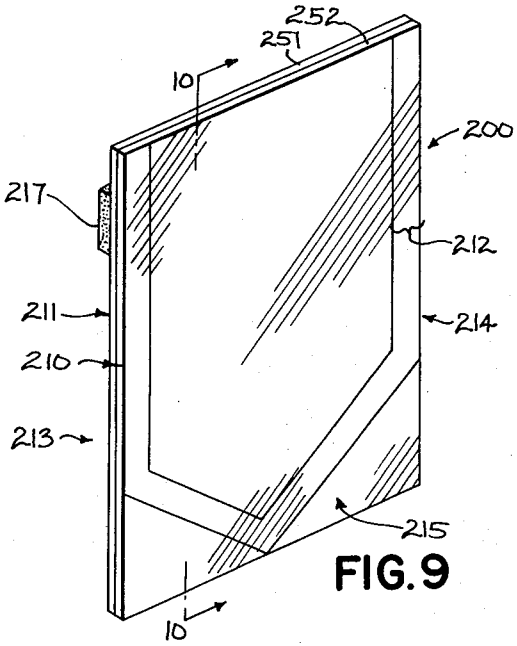
FIG.9
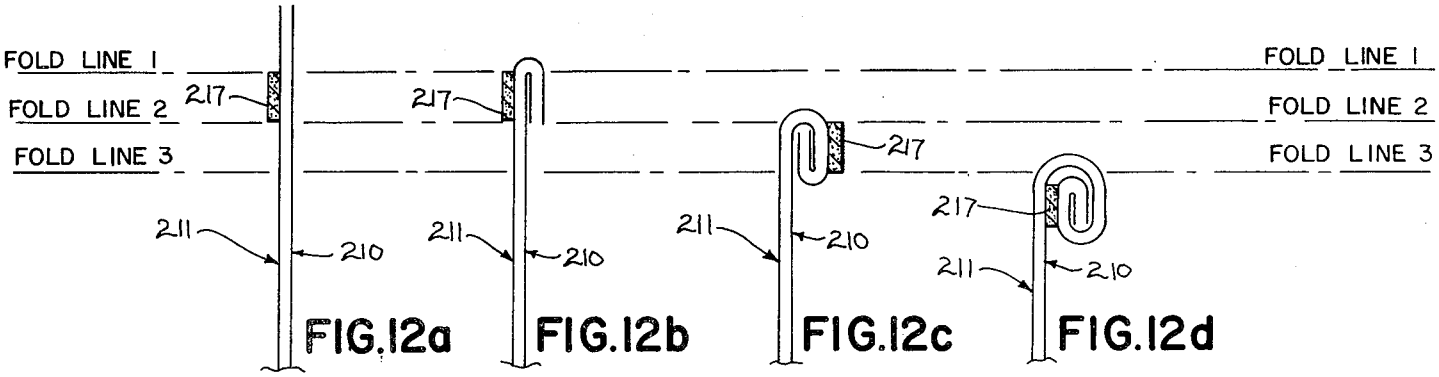

FOLD LINE 1
FOLD LINE 2
600
610
611
617
651
652
661
662

FOLD LINE 1
FOLD LINE 2
510
511
517
518
500
710
711
712
717
700

FOLD LINE 1
FOLD LINE 2
700
710
711
717
751
752
761
762

CLOSABLE POUCH

DESCRIPTION

Technical Field

The present invention relates to disposable sterilizable pouches used in medical facilities to sterilize articles used to care for patients. More particularly, the present invention is directed to self-sealing pouch closure structures that are easy to use and that enhance the capabilities of a pouch to resist ingress of contaminants.

Background of the Invention

There have been a substantial number of pouches, bags, and other such containers developed over the years in which the container opening is closed by folding over a portion of the container. Examples of such containers are disclosed in the U.S. Pat. Nos. Re. 28,318, 2,339,304, 3,070,280, 3,245,607, 3,420,433, 3,363,828, 4,084,689, West German Offenlegungsschrift No. P 25 18 229, and Belgium Pat. No. 548933.

It would be desirable to provide an improved self-sealing pouch that could be easily closed, and that when properly closed, provides a torturous path or barrier to the ingress of contaminants.

SUMMARY OF THE INVENTION

A pouch is provided with first and second opposing webs secured together partially around an interior portion of the webs. The first web has at least one generally straight end edge defining a portion of the pouch opening. The second web has at least one generally straight end edge oriented generally parallel to and in registry with the end edge of the first web and being generally free of the first web to provide an open mouth for the pouch.

An adhesive sealing strip having a strip-like configuration is provided on the first web parallel with and spaced from the first web one end edge so as to define a first fold line along the margin of the strip that is parallel to and nearest the first web one end edge. A second fold line is defined along the margin of the strip that is parallel to and furthest from the first web one end edge.

To close the pouch, the two top corners of the pouch at the mouth of the pouch are first folded on a 45 degree angle to create a pharmacy fold wherein the 45 degree fold line intersects the side of the pouch at the first fold line.

Next, the webs are folded together away from the first web along the first fold line, then along the second fold line, and then along a third fold line that is in registry with the repositioned first fold line. This orients the adhesive sealing strip against an adjacent region of the second web to form a closure seal in the pouch. The folded configuration inhibits ingress of contaminants.

In another embodiment of a novel pouch described herein, the adhesive sealing strip is disposed on the first web parallel with the first web one end edge with a first margin of the strip substantially in registry with the first web one end edge. The adhesive sealing strip defines a first fold line along a second margin of the strip that is parallel to and spaced inwardly from the first web one end edge.

To close this pouch, the webs are first folded together away from the first web along the first fold line and then along a second fold line defined on the pouch in registry with the folded over end edges of the webs. As a result of the two folds, the adhesive sealing strip becomes oriented against an adjacent region of the second web to form a closure seal in the pouch and provide a torturous path or barrier against the ingress of contaminants.

In another embodiment of a novel pouch disclosed herein, an adhesive sealing strip is provided on the first web parallel with and spaced from the first web one end edge. The spacing between the first web one end edge and the margin of the strip nearest the first web one end edge is substantially equal to twice the width of the strip. The pouch has a first fold line parallel to the strip and located midway between the first web one end edge and the margin of the strip nearest the first web one end edge. The adhesive sealing strip defines a second fold line along the other margin of the strip that is parallel to and nearest the first web one end edge. To close this pouch, the webs are initially folded together away from the second web along the first fold line and then along the second fold line to orient a portion of the second web against the adhesive sealing strip to form a closure seal and provide a torturous path or barrier to block the ingress of contaminants. A pharmacy fold may be provided in each corner of the pouch at the mouth of the pouch if desired.

Numerous other advantages and features of the present invention will become readily apparent from the following detailed description of the invention and of one embodiment thereof, from the claims, and from the drawings.

BRIEF DESCRIPTION OF THE DRAWINGS

In the accompanying drawings forming part of the specification and in which like numerals are employed to designate like parts throughout the same.

FIG. 9 is a front perspective view showing an embodiment of a novel unsealed pouch having a pressure sensitive adhesive on a foldable web portion of the pouch;

FIG. 10 is a cross-sectional view taken generally along the plane 10—10 in FIG. 9;

FIG. 11 is a front perspective view of another embodiment of a novel unsealed pouch having a gusseted transparent web;

Figure 13:
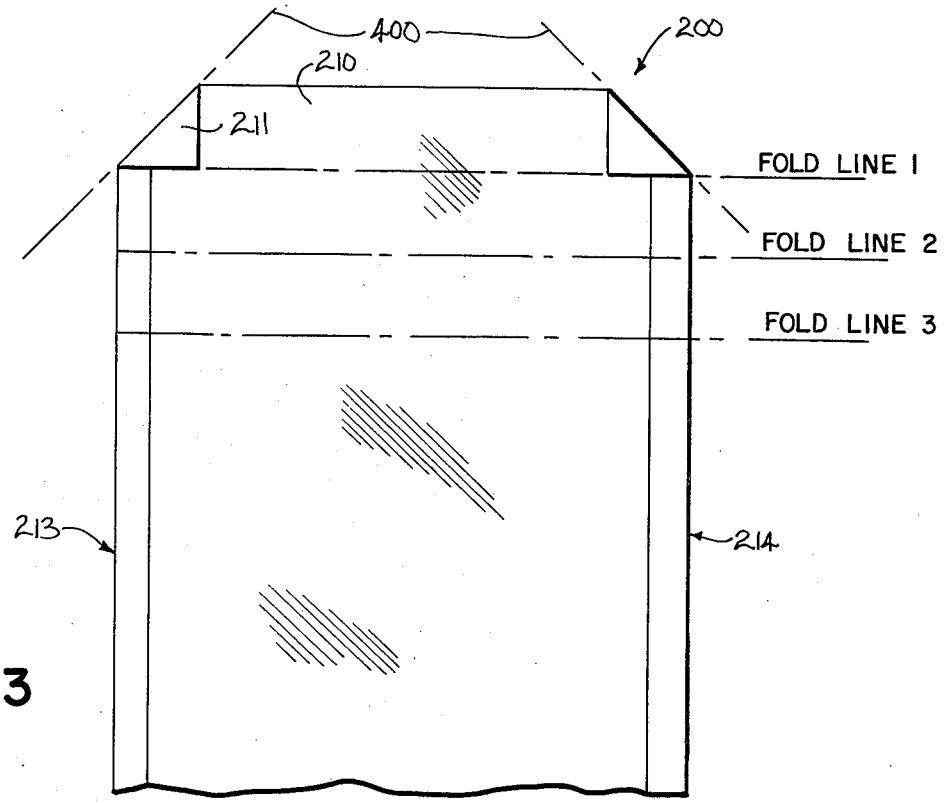
Figure 14:
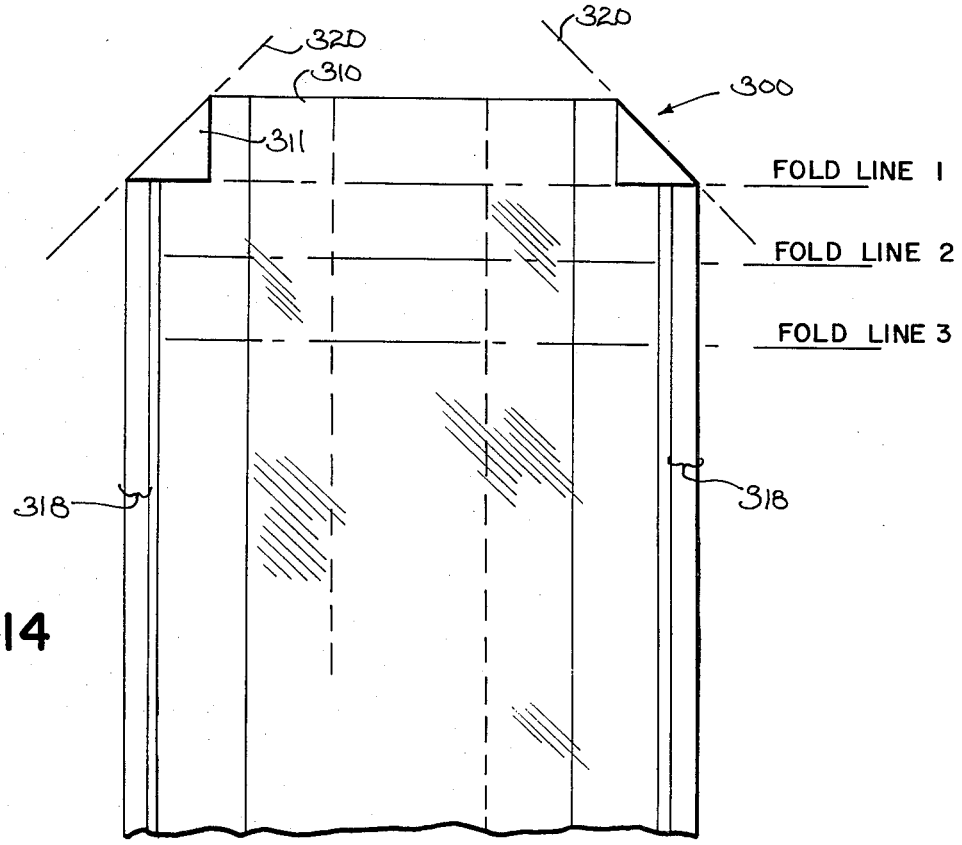
Figures 15, 16A, 16B, 16C, 17, 18, 19, 19A, 19B, 19C:
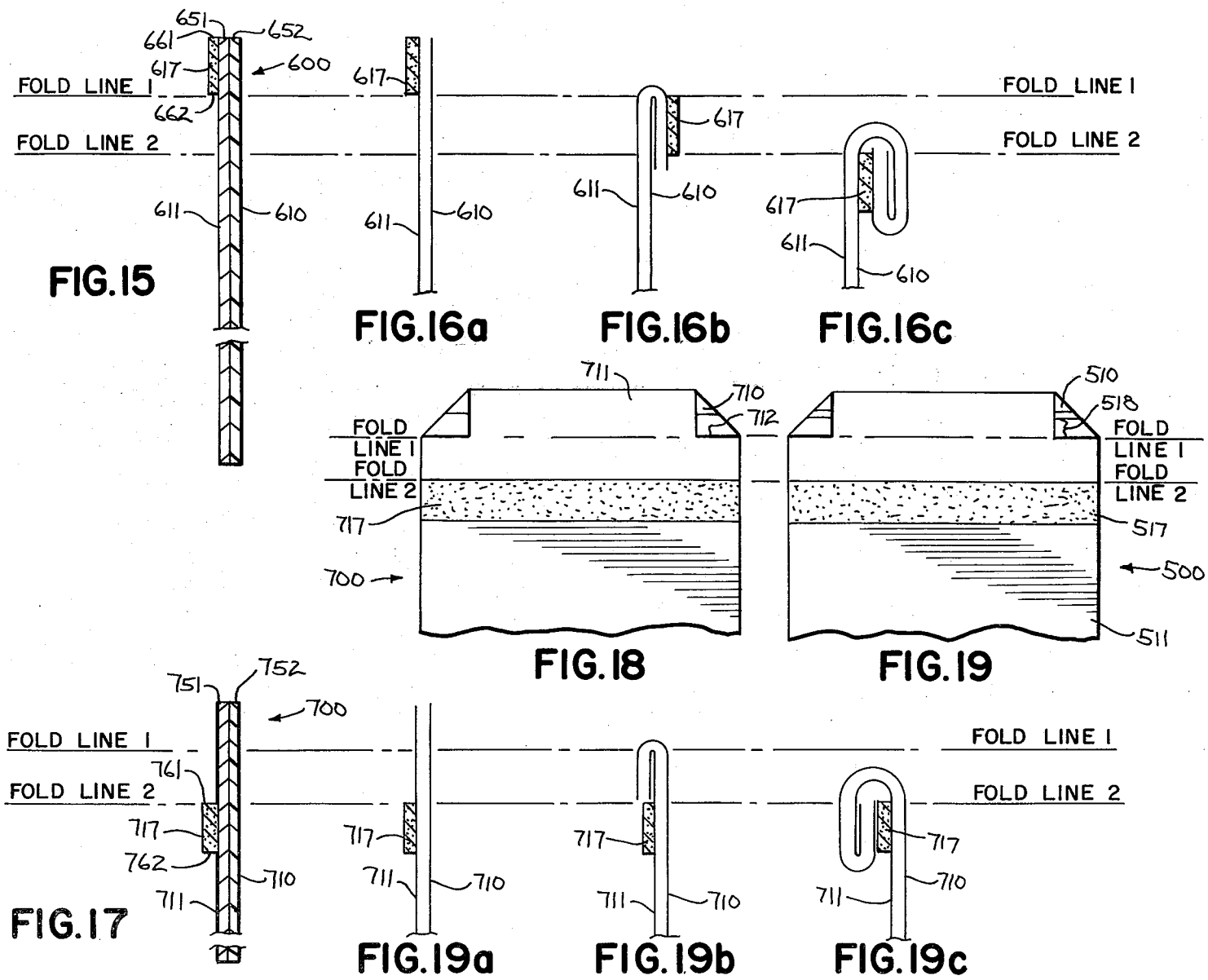

FIGS. **12*a*–12*d*** are simplified, schematic diagrams illustrating the folding of one end of a pouch to form a seal at the open end thereof;

FIG. 13 is a fragmentary, plan view of a pouch identical to that illustrated in FIGS. 9 and 10, but showing opposite corners of the mouth of the pouch folded in a pharmacy fold configuration;

FIG. 14 is a fragmentary, plan view of a pouch identical to that illustrated in FIG. 11, but showing opposite corners of the open mouth end of the pouch folded in a pharmacy fold configuration;

FIG. 15 is an enlarged, fragmentary, cross-sectional view of a pouch generally similar to that illustrated in FIGS. 9 and 10 except that the adhesive sealing strip is located adjacent the edge of the pouch mouth;

FIGS. 16*a*–16*c* are simplified, schematic diagrams illustrating the folding of the pouch of FIG. 15 to form a closure seal;

FIG. 17 is an enlarged, fragmentary, cross-sectional view of another embodiment of a pouch, similar to that illustrated in FIG. 15, but with the adhesive sealing strip disposed below the pouch mouth edge a distance equal to twice the width of the strip;

FIG. 18 is a fragmentary, plan view of the back side of the pouch illustrated in FIG. 17 but having a pharmacy fold formed in the opposite corners of the pouch mouth;

FIG. 19 is a fragmentary, plan view of the back side of a pouch having an adhesive sealing strip disposed in the location identical to that of the adhesive sealing strip of the pouch illustrated in FIG. 17, but wherein the pouch of FIG. 19 has a gusseted second web similar to that illustrated for the pouch in FIG. 11; and FIGS. 19*a*–19*c* are simplified, schematic diagrams illustrating the folding of each the pouches illustrated in FIGS. 18 and 19 so as to form a closure seal.

DESCRIPTION OF THE PREFERRED EMBODIMENT

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

The precise shapes and sizes of components herein described are not essential to the invention unless otherwise indicated.

For ease of description, the pouch of this invention will be described in a particular orientation, and terms such as upper, lower, horizontal, etc. will be used with reference to this orientation. It will be understood, however, that the pouch of this invention may be manufactured, stored, transported, used, and sold in an orientation other than the orientation described.

The pouch of this invention may be fabricated from various suitable materials and it is not intended to limit the invention to the materials set forth with reference to the preferred embodiments.

Figure 1:
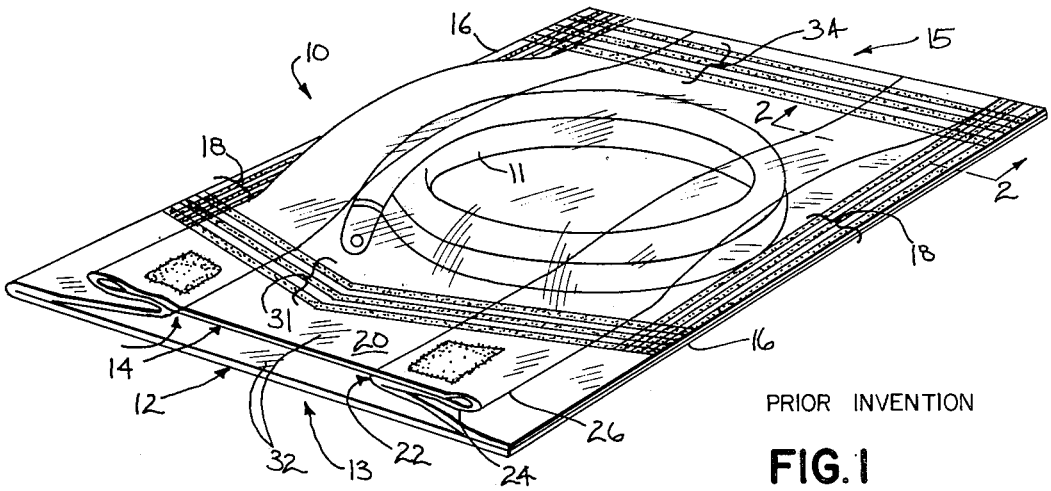
FIG. 1 is a perspective view of a completely sealed package of prior invention with the contents enclosed therein.

A gusseted package or pouch of prior invention, having a heat seal closure, is illustrated in FIG. 1 and designated therein generally by numeral 10. Such a pouch 10 is fully illustrated and described in the U.S. Pat. No. 4,176,746 and reference is directed thereto.

Briefly, the pouch 10 includes first and second webs of material 12 and 14, respectively, which are placed together to form the walls of the pouch having an openable end 13, a permanently heat sealed end 15, and marginal side edges 16.

The second web 14 has a transverse dimension between the opposite marginal side edges 16 that is greater than the transverse dimension between the marginal edges of the first web 12. The two webs 14 and 12 are interconnected along the marginal sides 16, in an area generally designated at 18 in FIG. 1, by means of three spaced-apart, parallel heat seals. The pouch is similarly heat sealed across one end at 34.

The second web 14 has a main body portion 20, as best illustrated in FIG. 1, that is substantially co-extensive in width to the width of the first web 12 and has two interconnecting segments 22 respectively located between the marginal edges 16 and the opposite sides of the main body portion 20.

Figure 2:
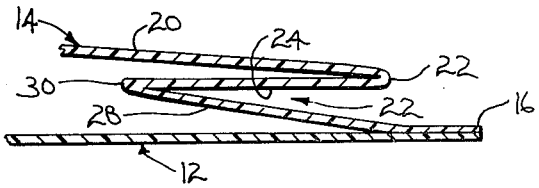
FIG. 2 is an enlarged, fragmentary, cross-sectional view taken generally along the plane 2—2 in FIG. 1.

As best illustrated in FIG. 2, the interconnecting segments 22 form a gusseted configuration in cross-section. Each segment 22 consists of an inwardly extending first portion 24 secured to the main body 20 along a first side fold line 26 and an outwardly extending second portion 28 in overlapping relation to the first portion 24, which outwardly extending portion 28 is located between a second side fold line 30, parallel to and spaced from the first side fold line 26, and the marginal edge 16.

The pouch 10 is provided to the user with the webs 14 and 12 open at the margin portions 32. These margin portions 32 may be grasped by the user to permit insertion of a medical apparatus 11 (FIG. 1) therein. Subsequently, the mouth of the package is heat sealed, as at 31. The sealed pouch 10 may later be opened to remove the medical apparatus 11 by grasping the unsecured margin portions 32 and pulling the margin portions 32 of the first and second webs 12 and 14, respectively, outwardly relative to each other to tear away the closure heat seal 31.

A pouch, such as that illustrated in FIG. 10, employs the heat seal 31 for closing the pouch after a medical apparatus has been inserted in the pouch. Thus, a heat sealing device is required to form the heat seal 31. It would be desirable to provide a self-sealing pouch that would have the gusseted configuration and that, when sealed, would provide a tortuous path or barrier to prevent the ingress of contaminants.

Figure 4:
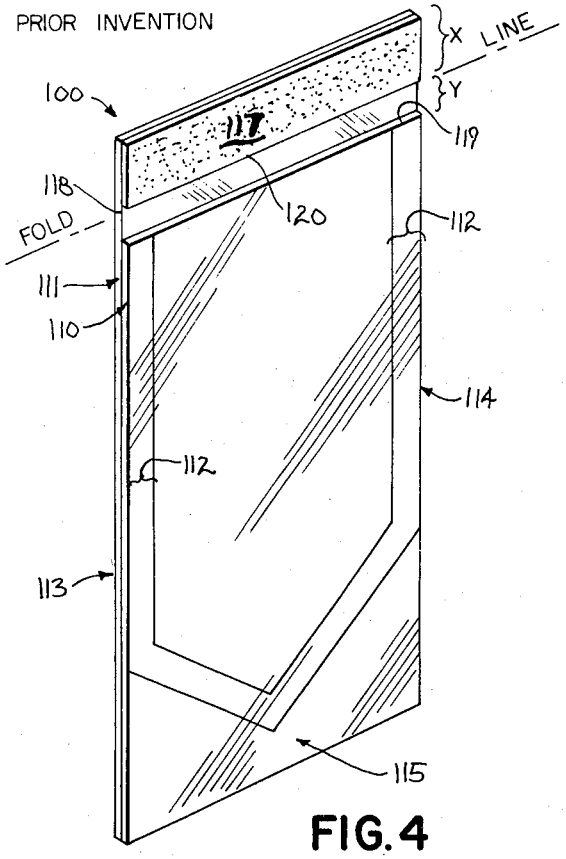
FIG. 4 is a front perspective view showing another type of unsealed pouch of prior invention having pressure sensitive adhesive on the flap portion of a web.

Another pouch known to the inventor of the present invention is that designated generally by numeral 100 in FIG. 4. The pouch preferably comprises two opposing webs, first web 111 and second web 110. Preferably, second web 110 is a transparent, thermally stable material such as a coated or laminated polyethylene terephthalate. Preferably, first web 111 is made of a steam permeable paper to permit the pouch to undergo autoclave sterilization.

The pouch has a generally rectangular configuration with opposing sides 113 and 114 and a bottom portion 115. The two webs are heat sealed together along the sides and bottom of the pouch by heat seal 112.

Opposite the heat sealed bottom portion 115, the pouch is open and the first web 111 extends therefrom as a flap 118. An adhesive 117 is applied across the surface of the flap 118. Preferably, the adhesive 117 is a pressure sensitive adhesive.

In the embodiment illustrated in FIG. 4, the adhesive 117 has a width X and is spaced a distance Y from the upper unsealed lip 119 of the web 110. The distance Y and the width X are suitably related so that the width of the adhesive 117 is broad enough to cover an area adjacent each side of lip 119 to form a continuous seal to prevent contamination of the contents of the pouch after sterilization as will be explained below.

Figure 5:
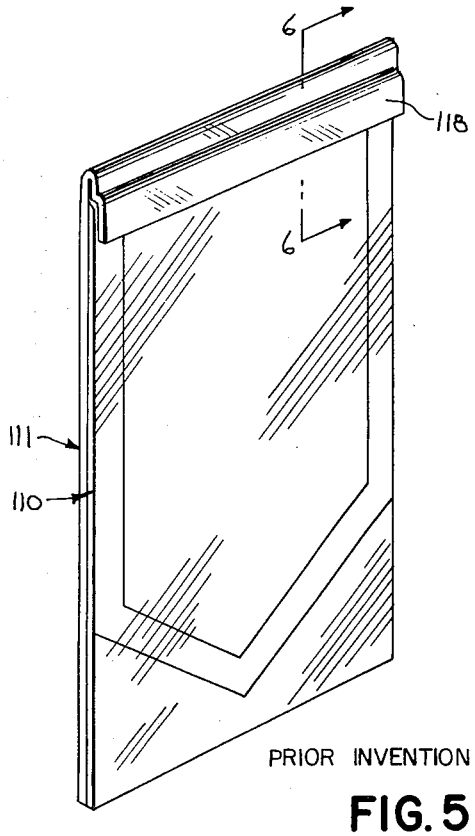
FIG. 5 is a front perspective view of the pouch of FIG. 4 in the sealed position.

FIG. 5 shows the prior invention pouch of FIG. 4 in the closed or sealed position. The closure of the pouch 100 is obtained by folding the flap 118 along the fold line generally defined by the adhesive strip bottom margin or edge 120. The margin 120 is the edge of the adhesive strip that is nearest the lip 119. The flap 118 is folded over and this essentially seals the web 111 to itself and also to the area on web 110 as is illustrated best in FIGS. 5 and 6.

Figure 6:
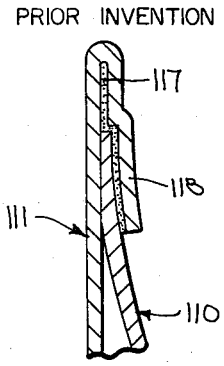
FIG. 6 is an enlarged, fragmentary, cross-sectional view taken generally along the plane 6—6 in FIG. 5.
Figure 8:
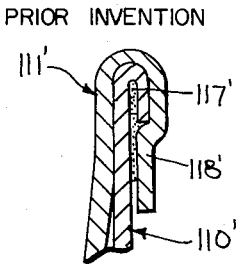
FIG. 8 is an enlarged, fragmentary, cross-sectional view taken generally along the plane 8—8 in FIG. 7, but with the flap portion of the pouch folded and sealed.
Figure 7:
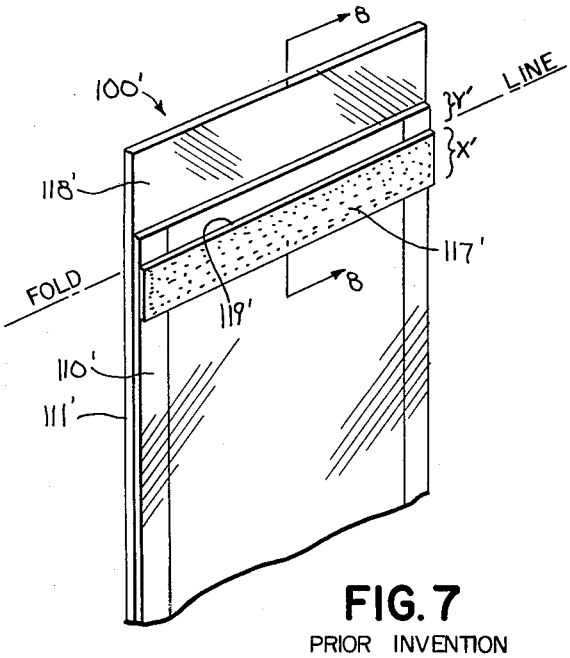
FIG. 7 is a fragmentary, front perspective view of another type of unsealed pouch of prior invention having pressure sensitive adhesive on a body portion of a web.

Another pouch of the prior invention, similar to the pouch 100 illustrated in FIGS. 4–6, is illustrated in FIGS. 7 and 8. Here the pressure sensitive adhesive strip 117′ is disposed on the outer surface of the web 110′ rather than on the inner surface of the web 111″.

The adhesive strip 117′ has a width X′ and is spaced a distance Y′ from the lip 119′ of the web 110′. The distance Y′ and the width X′ of the adhesive are cooperatively selected to provide a contaminant proof seal. The closure of the pouch illustrated in FIG. 7 is made by folding along a fold line generally defined by the edge of the adhesive 117′ nearest the lip 119′. The closed pouch is illustrated in FIG. 8 where it may be seen that the film of web 110′ is sealed to itself and to the flap 118′ of the web 111′ to form a contaminant proof seal.

It would be desirable to provide a pouch having generally planar opposed webs, similar to webs 110 (or 110′) and 111 (or 111′) of the pouches illustrated in FIGS. 4–8, but with an improved closure structure which would provide a tortuous path or barrier to reduce or block the ingress of contaminants into the pouch.

FIGS. 9 and 10 illustrate a first embodiment of a new closable pouch wherein the pouch is designated generally by the reference numeral 200. The pouch has an opposing web structure similar to the web structure of the prior invention pouch 100 illustrated in FIGS. 4–6 and described above. Basically, the pouch 200 has a first, or base web 211, which may be made of a steam permeable member to permit the pouch to undergo autoclave sterilization, and a second, or top web 210.

The second web 210 may be a transparent thermally stable material, such as a coated or laminated polyethylene terephthalate. The pouch may have a generally rectangular configuration with opposed side margins 213 and 214 and a bottom portion 215. The first and second opposing webs, 211 and 210, respectively, are secured together at least partially around an interior portion of the web, as by a heat seal 212 extending along the opposed side margins 213 and 214 and in a V-shaped configuration at the pouch bottom portion 215.

Opposite the bottom portion 215, the first web 211 has at least one generally straight end edge 251 defining a portion of the pouch opening.

The second web 210 has at least one generally straight end edge 252 oriented generally parallel to and in registry with the first web one end edge 251. The second web end edge 252 is free of the first web 211 to provide an open mouth for the pouch.

An adhesive 217 is provided in a strip-like configuration on the back or outer surface of first web 211 parallel with and spaced from the first web one end edge 251.

As best illustrated in FIG. 10, the adhesive strip 217 has a top edge 261 that defines a first fold line 1 along the margin of the strip that is parallel to and nearest the first web one end edge 251. The adhesive strip 217 has a bottom edge 262 defining a second fold line 2 along the margin of the strip that is parallel to and furthest from the first web one end edge 251.

FIGS. 12*a*–12*b* illustrate how the pouch 200 of FIGS. 9 and 10 may be folded to form a self-sealing closure. Specifically, with the pouch 200 oriented vertically as illustrated in FIG. 8 (for purposes of this description only), the webs 210 and 211 are first folded together away from the first web 211 along the first fold line 1 to the position illustrated in FIG. 12*b*. Next, the webs are folded together along the second fold line 2 to the position illustrated in FIG. 12*c*. Finally, the webs are folded together a third time along a third fold line 3 which is defined as being generally in registration with the repositioned first fold line 1 across the pouch.

After the third fold, the pouch has the configuration illustrated in FIG. 12*d* wherein the adhesive sealing strip 217 has been oriented against an adjacent region of the second web 210 to form a closure seal of the pouch opening. The closure seal, in combination with the folded configuration of the webs, is thus seen to provide a tortuous path or barrier against the ingress of contaminants into the pouch.

It is to be realized that FIGS. 12*a*–12*d* are schematic representations and show the webs and folds in a simplified manner. Specifically, for purposes of illustrating the folding sequence, the webs have been shown spaced apart and each fold has been shown with a relatively large radius. It is to be realized that with an actual pouch specimen, the webs would be in face-to-face contact, at least in the region of the folds, and each fold would have a relatively small fold radius, if not an angular crease. The fold crease, and the contact between the two inner faces of the webs, would provide barriers to the ingress of contaminants.

Figure 3:
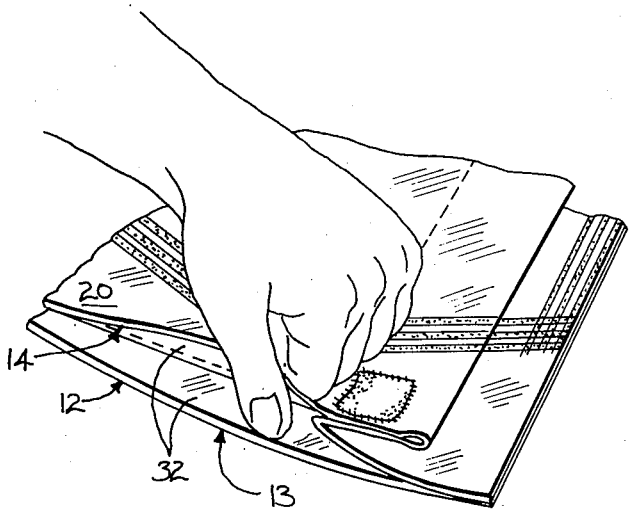
FIG. 3 is a fragmentary, perspective view of the package of FIG. 1 being opened.

A new gusseted pouch is illustrated in FIG. 11 and is designated therein by reference numeral 300. The pouch 300 is formed from two webs 311 and 310 to create a gusseted structure in much the same manner as that illustrated for the prior invention pouch 10 in FIGS. 1–3 described above.

The second web 310 is preferably gusseted and transparent and is heat sealed along the side margins and bottom portion of the pouch with a suitable heat seal 319. However, unlike the pouch 10 illustrated in FIGS. 1–3, the pouch 300 illustrated in FIG. 11 is not intended to be heat sealed across the open end after a medical apparatus has been inserted in the pouch 300. Rather, an adhesive strip 317 is provided on the back or outer surface of the first web 311. The adhesive strip is spaced from the first web end edge 351 and defines a first fold line 1 along the top margin 361 of the strip that is parallel to and nearest the first web one end edge 351. A second fold line 2 is defined along the bottom margin 362 of the adhesive strip 317 that is parallel to and furthest from the first web one end edge 351.

To close the pouch 300 illustrated in FIG. 11, the pouch is folded in the same manner as the pouch 200 illustrated in FIGS. 9 and 10 as described above.

In both of the pouches 200 and 300 described above, the adhesive strip is preferably of a conventional pressure sensitive type and may be covered with a conventional release paper (not illustrated) to avoid premature adhesion.

In some forms of the new pouches described above, it may be desirable to use a strip of pressure sensitive adhesive that is about ⅜ of an inch wide with the top edge of the adhesive strip located ⅜ of an inch from the pouch mouth edge.

Owing to the folding of the pouch (pouch 200 or 300) to effect the contaminant barrier, some shortening of the pouch occurs. Therefore, it may be desirable to increase the length of the pouch as is necessary to accommodate the selected health care products that are intended to be inserted in the pouch.

FIG. 13 illustrates a novel pouch having a rectangular, two-web construction identical to that of pouch 200 illustrated in FIGS. 9 and 10 and described above. Hence, the reference numerals used in FIGS. 9 and 10 are used for the identical pouch elements in FIG. 13.

The pouch 200 in FIG. 13 is viewed from the front, looking at the second web 210. The adhesive sealing strip is not visible but is located, as illustrated in FIGS. 9 and 10, between the first fold line 1 and the second fold line 2 on the outer surface of the first web 211.

Before folding the pouch first and second webs along the fold lines 1, 2, and 3 (in the manner sequentially illustrated in FIGS. 12*a*–12*d* and as described above in detail), an initial "pharmacy fold" is made in the opposite corners of the open, or second, end of the pouch. Each pharmacy fold consists of a fold in the corner of the pouch along a 45 degree line 400. On the right side of the pouch, the fold line 400 preferably intersects the right side margin 214 of the pouch at the first fold line 1. Similarly, at the left side of the pouch, the fold line 400 intersects the left side margin 213 of the pouch at the first fold line 1.

If desired, the pharmacy folds may be made smaller. That is, the 45 degree angle fold line 400 may intersect the pouch side margin (213 or 214) above the first fold line 1.

After making the pharmacy folds, the pouch is then folded as described above with respect to the embodiment illustrated in FIGS. 9 and 10 according to the schematic folding diagrams in FIGS. 12*a*–12*d*. The pharmacy fold, in combination with the subsequent folds along fold lines 1, 2, and 3, provides a greater barrier to contaminant ingress.

FIG. 14 illustrates the use of a pharmacy fold in the gusseted pouch 300 described above and more fully illustrated in FIG. 11. The pouch 300 is foldingly self-sealed at the open, second end by first forming a pharmacy fold in the second end corners. To this end, the open end corners of the pouch are folded about a 45 degree angle fold line 320 (FIG. 14) in the same manner as explained for the pharmacy fold in the pouch 200 illustrated in FIG. 13. After effecting the pharmacy fold, the pouch 300 is folded about the fold lines 1, 2, and 3 in the same manner as explained above with reference to the pouch 200 illustrated in FIG. 13.

FIG. 15 illustrates another embodiment of a pouch that may be foldingly self-sealed at a second, open end. The pouch is designated generally by reference numeral 600 in FIG. 15 and comprises a first web 611 and a second web 610. The webs are sealed together along the pouch side margins and along the bottom of the pouch. The composition and web construction of pouch 600 is substantially the same as the pouch 200 illustrated in FIGS. 9 and 10 and described above with reference thereto. However, unlike the pouch 200, the pouch 600 has an adhesive sealing strip 617 located at the pouch mouth on the first web 611. A first margin 661 of the adhesive sealing strip 617 is parallel with, and substantially in registry with, the first web one end edge 651. The adhesive sealing strip 617 has a second margin 662 parallel to, and spaced inwardly from, the first web one end edge 651. The strip second margin 662 defines a first fold line 1.

FIGS. 16*a*–16*c* schematically illustrate the folding of the pouch 600 to effect a closure. Specifically, the webs 611 and 610 are initially folded together away from the first web 611 along the first fold line 1. Then, the webs are folded along a second fold line which is in registry with the folded over end edges of the webs 611 and 610. This orients the adhesive sealing strip 617 against an adjacent region of the second web 610 to form a closure seal in the pouch. This provides a barrier against the ingress of contaminants.

Another embodiment of a self-sealing, closable pouch 700 is illustrated in FIG. 17. The pouch 700 has a basic web structure similar to that of pouch 200 illustrated in FIGS. 9 and 10 and described above with reference thereto. The pouch 700 has a first web 711 sealed along the lateral edges and bottom edge to a second web 710.

The open end of the pouch 700 is defined by at least one generally straight end edge 751 on the first web 711 and by at least one generally straight end edge 752 on the second web 710. The generally straight end edge 752 on the second web 710 is substantially parallel to, and in registry with, the first web one end edge 751. The webs 710 and 711 are unsecured along the end edges 751 and 752 to provide an open mouth for the pouch.

An adhesive sealing strip 717 is provided on the outer surface of the first web 711. The strip 717 is parallel with, and spaced from, the first web one end edge 751. The strip 717 has an upper margin 761 and a lower margin 762. The spacing between the first web one end edge 751 and an adhesive strip margin 761 nearest the first web one end edge 751 is substantially equal to twice the width of the strip 717.

For purposes of effecting a closure of the open end of the pouch 700, a first fold line 1 and a second fold line 2 are defined across the pouch. Specifically, the first fold line 1 is parallel to the adhesive sealing strip 717 and is located midway between the first web one end edge 751 and the adhesive strip margin 761 nearest the first web one end edge 751. The second fold line 2 is defined along, or coincident with, the adhesive strip margin 761 that is parallel to and nearest the first web one end edge 751.

To effect the self-closure seal of the pouch 700, the pouch webs 710 and 711 are first folded together away from the second web 710 along the first fold line 1 as best illustrated in FIG. 19*b*. Subsequently, as best illustrated in FIG. 19*c*, the pouch is then folded along the second fold line 2 to orient a portion of the second web 710 against the adhesive sealing strip 717 to form the closure seal in the pouch.

FIG. 18 illustrates an alternate self-seal closure fold configuration for the pouch 700. The pouch is viewed from the back side, looking at the first web 711. Specifically, a pharmacy fold may be provided in each corner of the pouch at the open end by initially folding over the pouch corners at a generally 45 degree angle on fold lines which intersect the side margins of the pouch at or above the first fold line 1. Subsequently, the pouch is folded as illustrated in FIGS. 19*a*–19*c* and as described above with reference to those figures.

FIG. 19 illustrates a gusseted pouch 500 having the same web configuration and construction as the pouch 300 described above with reference to FIGS. 11 and 14. The pouch 500 is viewed from the back side, looking at the first web 511. Consequently, three digit numerals in the 500 series are used to refer to the embodiment illustrated in FIG. 19 and the last two digits in each numeral designate elements that are similar or functionally analogous to the elements of the pouch 300 illustrated in FIGS. 11 and 14.

The pouch 500 in FIG. 19 is different in one major respect than the pouch 300 in FIGS. 11 and 14. Namely, FIG. 19 shows how the pouch 500 may be provided with pharmacy folds at the corners of the open end and then folded about the first fold line 1 and the second fold line 2 in a manner analogous to that for pouch 700 illustrated in FIGS. 19*a*–19*c*.

It is to be realized that the "fold lines" illustrated and described herein for the various pouches may or may not be physically indicated on the surface of the pouch by separate markings or indicia.

It is thus seen that with the novel pouch closures described herein, there is no need for special heat seal equipment to close and seal the pouch open end. Further, there is no need for a careful alignment of pressure sensitive adhesive strips with opposing surfaces.

Also, the novel pouches can be made from webs of a number of different materials and may be made gusseted or ungusseted.

Additionally, the novel pouches are easily and rapidly closed at practically any location and do not require the presence of a working surface on which to lay the pouches while closing them.

If desired, the adhesive comprising the adhesive strip may be a thermal setting adhesive of the non-reusable type which would prevent the closed pouch from being reopened.

From the foregoing, it will be observed that numerous variations and modifications may be effected without departing from the true spirit and scope of the novel concept of the invention. It is to be understood that no limitation with respect to the specific structure illustrated therein is intended or should be inferred. It is, of course, intended to cover by the appended claims all such modifications as fall within the scope of the claims.

What is claimed is:

1. A two-ended, gusseted pouch sealed inwardly of a first end and having an opening that is foldingly self-sealed at a second end, said pouch comprising:

first and second opposing webs;

said webs having substantially coterminous opposed side edges defining side edges of the pouch, said second web having a transverse dimension greater than the first web, said second web further having first and second spaced parallel gusset fold lines adjacent each side edge to produce an inwardly extending first portion and an outwardly extending second portion in overlapping relation whereby a gusset is formed in said second web adjacent each side edge thereof;

means for adhering said first web to said second web to form a seal across said pouch inwardly of said first end and adjacent the side edges of said pouch;

said first web having a configuration before being foldingly self-sealed at said second end wherein at least one generally straight end edge of said first web defines a portion of the self-sealed pouch opening at said second end;

said second web having a configuration before being foldingly self-sealed at said second end wherein at least one generally straight end edge of said second web is orientated generally parallel to and in registry with said first web one generally straight end edge to define a portion of said self-sealed opening at said second end;

an adhesive sealing strip having a strip-like configuration carried on said first web parallel with and spaced inwardly from said first web one generally straight end edge, said adhesive sealing strip having two generally parallel, straight margins, said adhesive sealing strip extending transversely across said first web, said adhesive sealing strip defining a closure first fold line along the margin of the strip that is parallel to and nearest said first web one generally straight end edge, said strip defining a closure second fold line along the margin of the strip that is parallel to and furthest from said first web one generally straight end edge;

two pharmacy folds of said webs at said second end of said pouch, one of said pharmacy folds being located at one side of said pouch and the other of said pharmacy folds being located at the other side of said pouch, each said pharmacy fold including a corner portion of said pouch folded inwardly along a substantially 45 degree fold line relative to said pouch side edges, said 45 degree fold line intersecting one of said pouch side edges at said first fold line; and said pouch being foldingly self-sealed at said second end with said webs being folded away from said first web along said closure first fold line, then being folded along said closure second fold line, and then being folded along a closure third fold line that is in registry with the repositioned closure first fold line thus orienting the adhesive sealing strip against an adjacent region of the second web to form a self-sealed closure at said pouch second end.

2. A two-ended pouch sealed inwardly of a first end and having an opening that is foldingly self-sealed at a second end, said pouch comprising:

first and second opposing webs secured together at least partially around an interior portion of the webs, said webs having substantially coterminous opposed side edges defining side edges of the pouch;

said first web having a configuration before being foldingly self-sealed at said second end wherein at least one generally straight end edge of said first web defines a portion of the opening at the pouch second end;

said second web having a configuration before being foldingly self-sealed at said second end wherein at least one generally straight end edge of said second web is oriented generally parallel to and in registry with said first web one generally straight end edge to define a portion of the opening at said second end;

an adhesive sealing strip having a strip-like configuration carried on said first web parallel with and spaced inwardly from said first web one generally straight end edge, said adhesive sealing strip having two generally parallel, straight margins, said adhesive sealing strip extending transversely across said first web, said adhesive sealing strip defining a closure first fold line along the margin of the strip that is parallel to and nearest said first web one generally straight end edge, said strip defining a closure second fold line along the margin of the strip that is parallel to and furthest from said first web one generally straight end edge;

two pharmacy folds of said webs at said second end of said pouch, one of said pharmacy folds being located at one side of said pouch and the other of said pharmacy folds being located at the other side of said pouch, each said pharmacy fold including a corner portion of said pouch folded inwardly along a substantially 45 degree fold line relative to said pouch side edges, said 45 degree fold line intersecting one of said pouch side edges at said first fold line; and said pouch being foldingly self-sealed at said second end with said webs being folded away from said first web along said closure first fold line, then being folded along said closure second fold line, and then being folded along a closure third fold line that is in registry with the repositioned closure first fold line thus orienting the adhesive sealing strip against an adjacent region of the second web to form a self-sealed closure at said pouch second end.

3. A two-fold closable pouch comprising:

first and second opposing webs secured together at least partially around an interior portion of the webs, said webs having substantially coterminous opposed side edges defining side edges of the pouch;

said first web having at least one generally straight end edge defining a portion of the pouch opening;

said second web having at least one generally straight end edge oriented generally parallel to and in registry with said first web one generally straight end edge and being unsecured to said first web to provide an open mouth for said pouch; and an adhesive sealing strip having a strip-like configuration carried on said first web parallel with said first web one generally straight end edge, said adhesive sealing strip having two generally parallel, straight margins, said adhesive sealing strip extending transversely across said first web, said adhesive sealing strip having a first one of said two margins substantially in registry with said first web one end edge, said strip defining a closure first fold line along the second of said two margins of the strip that is parallel to and spaced inwardly from said first web one generally straight end edge whereby said webs may be initially folded away from said first web along said closure first fold and then along a closure second fold line in registry with the folded over straight end edges of said webs thus orienting the adhesive sealing strip against an adjacent region of the second web to form a closure seal in said pouch.

4. A two-ended, gusseted pouch sealed inwardly of a first end and open at a second end, said pouch comprising:

first and second opposing webs;

said webs having substantially coterminus opposed side edges defining side edges of the pouch, said second web having a transverse dimension greater than the first web, said second web further having first and second spaced parallel gusset fold lines adjacent each side edge to produce an inwardly extending first portion and an outwardly extending second portion in overlapping relation whereby a gusset is formed in said second web adjacent each side edge thereof;

means for adhering said first web to said second web to form a seal across said pouch inwardly of said first end and adjacent the side edges of said pouch;

said first web having at least one generally straight end edge defining a portion of the pouch opening;

said second web having at least one generally straight end edge oriented generally parallel to and in registry with said first web one generally straight end edge and being unsecured to said first web to provide an open mouth for said pouch; and an adhesive sealing strip having a strip-like configuration carried on said first web parallel with said first web one generally straight end edge, said adhesive sealing strip having two generally parallel, straight margins, said adhesive sealing strip extending transversely across said first web, said adhesive sealing strip having a first one of said two margins substantially in registry with said first web one generally straight end edge, said strip defining a closure first fold line along the second of said two margins of the strip that is parallel to and spaced inwardly from said first web one generally straight end edge whereby said webs may be initially folded away from said first web along said closure first fold line and then along a closure second fold line in registry with the folded over straight end edges of said webs thus orienting the adhesive sealing strip against an adjacent region of the second web to form a closure seal in said pouch.

5. A closable pouch comprising:

first and second opposing webs secured together at least partially around an interior portion of the webs, said webs having substantially coterminous opposed side edges defining side edges of the pouch;

said first web having at least one generally straight end edge defining a portion of the pouch opening;

said second web having at least one generally straight end edge orientated generally parallel to and in registry with said first web one generally straight end edge and being unsecured to said first web to provide an open mouth for said pouch; and an adhesive sealing strip having a strip-like configuration carried on said first web, said adhesive sealing strip having two generally parallel, straight margins, said adhesive sealing strip extending transversely across said first web, said adhesive sealing strip being parallel with and spaced inwardly from said first web one generally straight end edge, the spacing between said first web one generally straight end edge and the margin of said strip nearest said first web one generally straight end edge being substantially equal to twice the width of said strip, said first web having a closure first fold line parallel to said strip and located midway between said first web one generally straight end edge and the margin of said strip nearest said first web one generally straight end edge, said strip defining a closure second fold line along the margin of the strip that is parallel to and nearest said first web one generally straight end edge whereby said webs may be first folded away from said second web along said closure first fold line and then along said closure second fold line thus orienting a portion of the second web against said adhesive sealing strip to form a closure seal in said pouch.

6. The pouch in accordance with claim 5 in which said pouch is a two-ended, gusseted pouch sealed inwardly of a first end and having said mouth open at a second end defined by said first and second web one end edges; in which said second web has a transverse dimension greater than the first web; in which said webs further have substantially coterminus opposed side edges, said second web having first and second spaced gusset parallel fold lines adjacent each said edge to produce an inwardly extending first portion and an outwardly extending second portion in overlapping relation whereby a gusset is formed in said second web adjacent each side edge thereof; and in which said pouch further includes means for adhering said first web to said second web to form a seal at said first end and adjacent the side edges of said pouch between said sealed first end and said second open end.

7. A two-ended pouch sealed inwardly of a first end and having an opening that is foldingly self-sealed at a second end, said pouch comprising:

first and second opposing webs secured together at least partially around an interior portion of the webs, said webs having substantially coterminous opposed side edges defining side edges of the pouch;

said first web havng a configuration before being foldingly self-sealed at said second end wherein at least one generally straight end edge of said first web defines a portion of the pouch second end self-sealed opening;

said second web having a configuration before being foldingly self-sealed at said second end wherein at least one generally straight end edge of said second web is oriented generally parallel to and in registry with said first web one generally straight end edge to define a portion of said second end self-sealed opening;

an adhesive sealing strip having a strip-like configuration carried on said first web, said adhesive sealing strip having two generally parallel, straight margins, said adhesive sealing strip extending transversely across said first web, said adhesive sealing strip being parallel with and spaced inwardly from said first web one generally straight end edge, the spacing between said first web one generally straight end edge and the margin of said strip nearest said first web one generally straight end edge being substantially equal to twice the width of said strip, said first web having a closure first fold line parallel to said strip and located midway between said first web one generally straight end edge and the margin of said strip nearest said first web one generally straight end edge, said strip defining a closure second fold line along the margin of the strip that is parallel to and nearest said first web one end edge;

two pharmacy folds of said webs at said second end of said pouch, one of said pharmacy folds being located at one side of said pouch and the other of said pharmacy folds being located at the other side of said pouch, each said pharmacy fold including a corner portion of said pouch folded inwardly along a substantially 45° degree fold line relative to said pouch side edges, said 45 degree fold line intersecting one of said pouch side edges at said first fold line; and said pouch being foldingly self-sealed at said second end with said webs being folded together away from said second web along said closure first fold line and then along said closure second fold line thus orienting a portion of the second web against said adhesive sealing strip to form a selfsealed closure at said pouch second end.

8. The pouch in accordance with claim 7 in which said pouch is a two-ended, gusseted pouch sealed inwardly of a first end and having said mouth at a second end defined by said first and second web one end edges; in which said second web has a transverse dimension greater than the first web; in which said webs further having substantially coterminus opposed side edges, said second web having first and second spaced parallel gusset fold lines adjacent each said side edge to produce an inwardly extending first portion and an outwardly extending second portion in overlapping relation whereby a gusset is formed in said second web adjacent each side edge thereof; and in which said pouch further includes means for adhering said first web to said second web to form a seal at said first end and adjacent the side edges of said pouch between said sealed first end and said second end.

* * * * *

UNITED STATES PATENT AND TRADEMARK OFFICE

CERTIFICATE OF CORRECTION

PATENT NO. : 4,323,189

DATED : April 6, 1982

INVENTOR(S) : Joseph Regenstein, Jr.

It is certified that error appears in the above-identified patent and that said Letters Patent is hereby corrected as shown below:

Column 13 (Claim 6), line 4, insert -- side -- after "said" and before "edges"

Signed and Sealed this

*Nineteenth* Day of *March 1985*

[SEAL]

*Attest:*

DONALD J. QUIGG

*Attesting Officer*

*Acting Commissioner of Patents and Trademarks*